US008052365B2

(12) United States Patent
Aller

(10) Patent No.: US 8,052,365 B2
(45) Date of Patent: Nov. 8, 2011

(54) MAGNETIC SAFETY PUSHPIN

(75) Inventor: Jared H. Aller, San Francisco, CA (US)

(73) Assignee: Enlisted Design, LLC, Oakland, CA (US)

( * ) Notice: Subject to any disclaimer, the term of this patent is extended or adjusted under 35 U.S.C. 154(b) by 237 days.

(21) Appl. No.: 12/424,462

(22) Filed: Apr. 15, 2009

(65) Prior Publication Data

US 2010/0263174 A1 Oct. 21, 2010

(51) Int. Cl.
*E01B 9/06* (2006.01)

(52) U.S. Cl. ..... 411/439; 411/922

(58) Field of Classification Search ..... 411/439, 411/441, 484, 922, 21; 24/115 G, 710.4, 24/303; 248/685; 70/57.1
See application file for complete search history.

(56) References Cited

U.S. PATENT DOCUMENTS 1,857,158 A * 5/1932 Maloney ..... 248/685
4,005,507 A 2/1977 Yamazaki
7,004,705 B1 2/2006 Stanley
2008/0005873 A1 1/2008 Barton et al.
2010/0000057 A1* 1/2010 Wang ..... 24/356
* cited by examiner

*Primary Examiner* — Gary Estremsky
(74) *Attorney, Agent, or Firm* — Knobbe Martens Olson & Bear, LLP

(57) ABSTRACT

A pushpin device of one embodiment preferably comprises a head adapted to allow a user to apply pressure to the head without discomfort. A longitudinally extending fastening member comprises a point at a distal end and is coupled to the head at a proximal end. A base comprises an aperture. The aperture is configured to allow the fastening member to pass through the base as the head moves proximate to the base. An outer member is coupled to the head and the base. The outer member comprises a first position in which the head is spaced from the base and the outer member encloses a longitudinal segment of the fastening member. In a second position the head is proximate to the base and the outer member is deformed, thereby allowing the fastening member to extend through the aperture. The outer member exerts a countering force on the base and the head. One of the head and the base comprises magnetically susceptible material and the other comprises magnetic material. A magnetic force between the head and the base maintains the outer member in the second position in opposition to the countering force.

14 Claims, 5 Drawing Sheets

MAGNETIC SAFETY PUSHPIN

TECHNICAL FIELD

The present device relates to push pins and magnets used to secure material such as papers, drawing, photos and the like to vertical walls, magnetic surfaces, or ceilings, and the safety concerns with using these devices.

BACKGROUND OF THE RELATED ART

Push pins or thumbtacks are used to secure articles such as papers, drawings, photos and the like to vertical walls, bulletin boards, and ceilings. Push pins or thumbtacks typically have a head from which protrudes a pin from one side. The pin has a tip which is customarily inserted through an article and secured to a support surface.

One drawback to the conventional pushpin is that the sharp tips are always exposed and, when handled by or around a user, can create bodily injury. Furthermore, push pins can cause damage to articles that they are inserted through. Magnets also have drawbacks in that they need a ferrous surface to adhere to. Without a metal surface, magnetic bulletin board, or the like, they are rendered useless.

SUMMARY OF THE INVENTION

One aspect of the invention is the recognition of a need for a device that creates safety around the use of pushpins, has the ability to not damage adhered articles, and is readily adaptable to be used as a pushpin or a magnet. The systems, methods, and devices of the invention have several aspects, no single one of which is solely responsible for its desirable attributes. Without limiting the scope of the invention, certain features will now be discussed briefly. The systems, methods, and devices disclosed herein avoid the problems of past devices while adding functionality and safety.

According to one embodiment, a magnetic safety pushpin device that may be used as a magnet or a pushpin is disclosed. The magnetic safety pushpin device is comprised of a metal head with a protruding pin. The head and the protruding pin are partially or fully enveloped by a deformable elastomeric outer member. The bottom of the outer member houses a magnetic ring with a hole through which the pin can protrude out. When the elastomeric member is in its natural state the device is usable as a magnet, and the outer member acts as a safety sheath for the pin. When the elastomeric member is compressed the pin protrudes through the hole of the magnetic ring to be used as a pushpin. In this state the magnet attracts the metal pin head opposing the pulling force of the outer member, keeping it compressed. Other uses for the disclosed device include using two devices together. For instance one device could be compressed and pinned into a pinnable surface while another device could sandwich an article to be held between its magnet and the head of the pinned device, effectively making a non magnetic surface into a magnetic surface.

In one embodiment, the body of a device comprises a pin head, a pin which protrudes from the head, an elastomeric deformable outer member that partially or fully envelopes the head and pin, and a magnetic ring through which the pin can protrude. Consistent with one embodiment of the body in its retracted form, the pin head is away from the magnet, the outer member is in its natural state, and the pin is retracted inside the outer member. In this state, the device may be used as a magnet to adhere articles to ferrous surfaces, or to adhere articles between the metal head and the magnet of two devices. Consistent with one embodiment of the body in its compressed form, the pin head is attracted to the magnet, the outer member is compressed, and the pin is protruding through the hole of the magnetic ring. In this state the device is primarily used as a pushpin to adhere articles to multiple types of surfaces. Consistent with one embodiment of the body in either form, the device can adhere articles to a surface without puncturing them or ruining them in any way.

According to one embodiment, a pushpin device is adapted to affix articles to different surfaces by piercing, by magnetic attraction, or by clamping and to enclose a pin to allow safer handling of the device by reducing the danger of injury being inflicted by an exposed point of the pin. The device comprises a pin head comprising magnetically susceptible material. The pin head is adapted to allow a user to apply pressure to the pin head without discomfort. A longitudinally extending pin has a proximal portion and a distal portion. The proximal portion of the longitudinally extending pin is coupled to the pin head and the distal portion of the longitudinally extending pin comprises a point at a distal end. The point is adapted to allow the pin to penetrate user selected articles that are to be affixed to a surface. A base comprises a magnetic material and has an aperture. The base is magnetically attracted to the pin head by a magnetic force such that when the pin head is positioned proximate to the base the magnetic force maintains the pin head in a position proximate to the base in opposition to a countering force. The aperture is aligned with the pin and is configured to allow the pin to pass through the base as the pin head moves proximate to the base. A deformable outer member is coupled to the pin head at a first end and coupled to the base at a second end that is distal to the first end. The deformable outer member further comprises a first position wherein the pin head is spaced from the base and the deformable outer member is substantially undeformed and surrounds the entire pin along the longitudinal axis of the pin. In a second position the deformable outer member is deformed and the pin head is proximate to the base, thereby allowing the pin to extend through the aperture in the base to penetrate an article. The deformable outer member exerts the countering force on the base and the pin head.

In another embodiment, a pushpin device is adaptable to affix articles to different surfaces and to improve user safety by reducing the danger of injury being inflicted by an exposed point. The device comprises a head adapted to allow a user to apply pressure to the head without discomfort. A longitudinally extending fastening member comprises a point at a distal end and is coupled to the head at a proximal end. A base comprises an aperture. The aperture is configured to allow the fastening member to pass through the base as the head moves proximate to the base. An outer member is coupled to the head and the base. The outer member comprises a first position in which the head is spaced from the base and the outer member encloses a longitudinal segment of the fastening member. The outer member comprises a second position wherein the head is proximate to the base and the outer member is deformed, thereby allowing the fastening member to extend through the aperture. The outer member exerts a countering force on the base and the head. One of the head and the base comprises magnetically susceptible material and the other comprises magnetic material. A magnetic force between the head and the base maintains the outer member in the second position in opposition to the countering force.

According to another embodiment, a fastening device is preferably adapted to increase user safety and to allow articles to be affixed to various types of surfaces by piercing the article or by clamping the article. The device comprises a head comprising a first surface adapted to be safely handled by a user. A pin has a proximal portion and a distal portion, the proximal portion of the pin is coupled to the head and the distal portion of the pin comprises a tip. A base is configured to allow at least part of the pin to extend therethrough. A flexible member has a proximal portion and a distal portion. The distal portion is coupled to the base and the proximal portion is coupled to the head. The flexible member is adapted to allow the head to be positioned proximate to the base. One of the head and the base comprises magnetic material and the other comprises magnetic material or magnetically susceptible material. The pin extends through the base when the pin head is positioned proximate to the base.

According to another embodiment, a fastening device is preferably configured to improve user safety while permitting an article to be affixed to various surfaces. The pushpin device comprises a head adapted allow a user to comfortably handle and exert pressure on the head. A pin is coupled to the head. The pin comprises a substantially sharp point distal to the head. A base comprises an opening configured to allow the pin to move through the opening. A deformable outer member comprises a proximal end coupled to the head and a distal end coupled to the base. The deformable outer member defines a cavity and has a first position and a second position. At least part of the head, part of the base, and the entire pin are positioned within the cavity when the deformable outer member is in the first position wherein the head and the base are spaced apart. When the deformable outer member is in the second position the head and the base are proximate to each other and at least part of the pin extends through the opening. In the second position the deformable outer member exerts an opposing force urging the head and the base apart. At least one of the head and the base comprises a magnetic material, and the head is magnetically attracted to the base, thereby exerting a force against the opposing force and maintaining the deformable outer member in the second position.

In another embodiment, a fastening device is configured to reduce the risk of injury to a user and allow a user to affix articles to various surfaces by piercing or by friction. The fastening device comprises a head configured to allow a user to manually exert pressure on the head without discomfort. A fastening member comprises a substantially sharp point adapted to penetrate an article. A base comprises an aperture adapted to permit the fastening member to extend therethrough. Means is provided for enclosing the fastening member in a first configuration when the fastening member is not in use to reduce the risk of user injury caused by the substantially sharp point. Means is provided for coupling the fastening device to a first user selected surface in the first configuration, thereby allowing the fastening device to clamp an article to be affixed to the first user selected surface. Means is provided for coupling the fastening device to a second user selected surface in a second configuration, thereby allowing the fastening device to pierce an article to be affixed to a second user selected surface. Means is provided for holding the head proximate to the base in opposition to a resistive force that urges the base and the head apart, thereby allowing the fastening member to remain extended through the base to pierce an article to be affixed to a second user selected surface in the second configuration.

This summary may be more fully understood with review of the drawings and the further attached descriptions.

BRIEF DESCRIPTION OF THE DRAWINGS

For the understanding of the device sought to be protected, there are here included illustrations of the device, an inspection of which, when considered along with the subject's description, should put forth its advantages, and make it readily understood and appreciated as a unique configuration.

DETAILED DESCRIPTION OF CERTAIN EMBODIMENTS

Embodiments of the invention will now be described with reference to the accompanying figures, wherein like numerals refer to like elements throughout. The terminology used in the description presented herein is not intended to be interpreted in any limited or restrictive manner, simply because it is being utilized in conjunction with a detailed description of certain specific embodiments of the invention. Furthermore, embodiments of the invention may include several novel features, no single one of which is solely responsible for its desirable attributes or which is essential to practicing the inventions herein described.

Referring to FIGS. 1-5 there is an illustrated embodiment of a magnetic pushpin device, designated by the numeral 10. The device 10 may be used in at least three general configurations, which will be explained further below.

Figure 1:
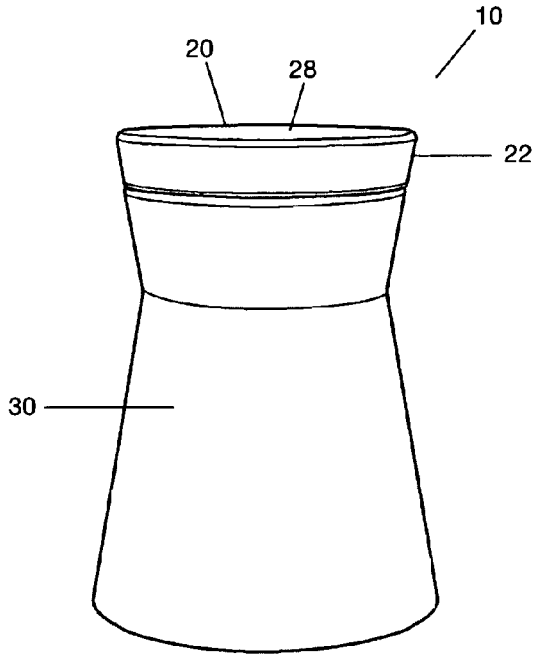
FIG. 1 is a perspective view of one embodiment of the magnetic safety push pin device consistent with the present invention.
Figure 2:
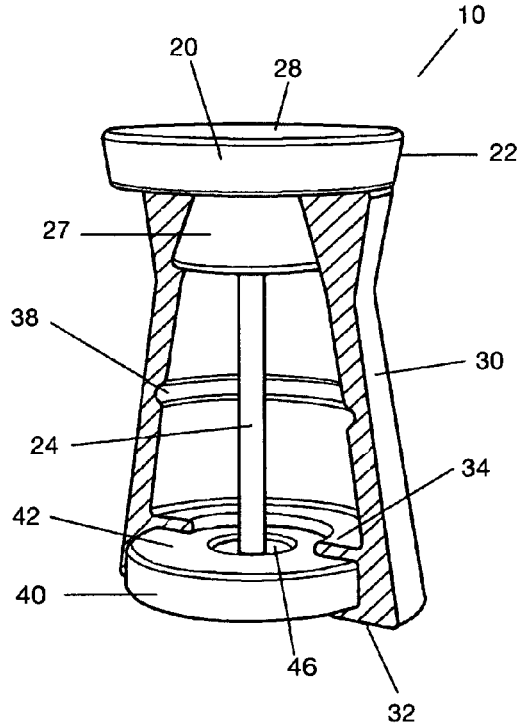
FIG. 2 is a cut-away perspective view of one embodiment of the magnetic safety push pin device shown in FIG. 1
Figure 3:
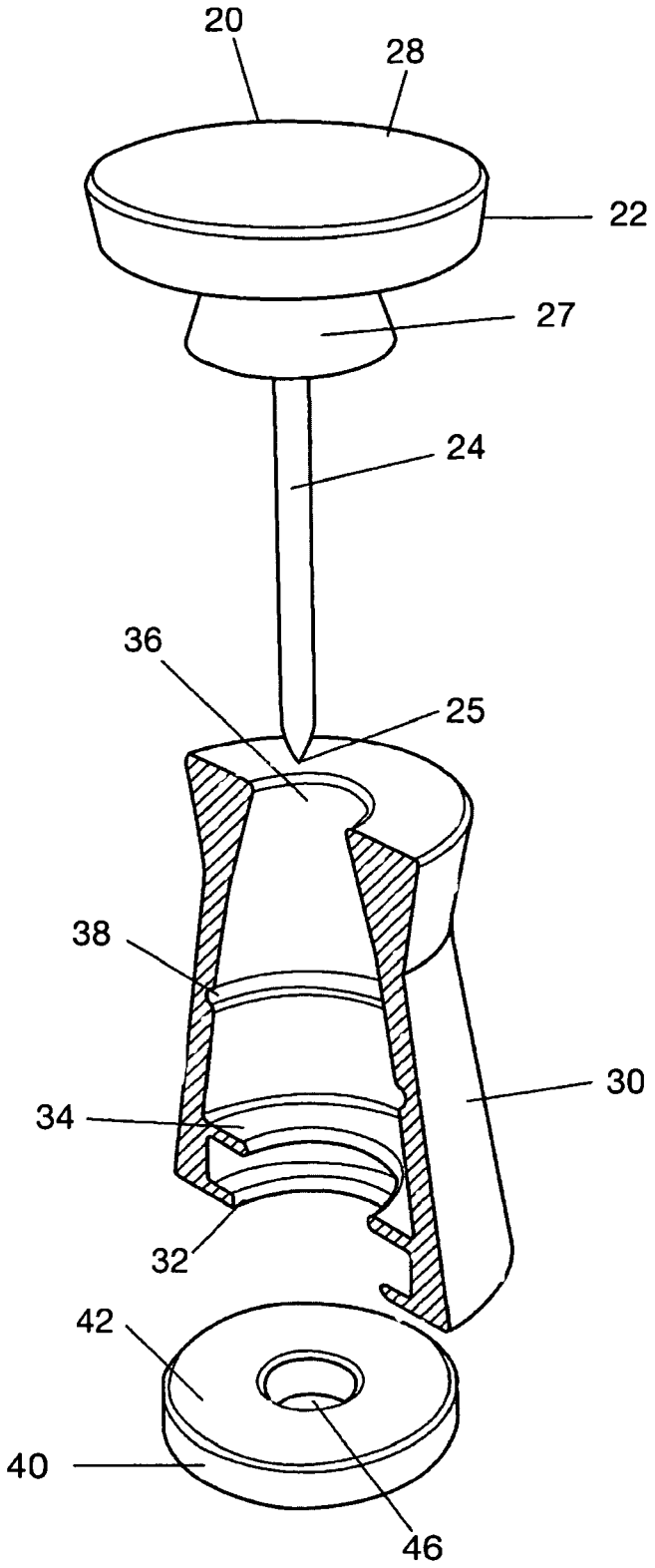
FIG. 3 is an exploded partial cut-away perspective view detailing one embodiment of the components of the magnetic safety push pin device.

FIGS. 2 and 3 illustrate embodiments of the device 10 that comprise a pin head 20, a pin 24, a magnet ring 40, and a deformable elastomeric outer member 30 that surrounds at least part of the vertical sides of the pin 24 and also surrounds and secures at least part of the pin head 20 and the magnetic ring 40. The pin 24 generally extends from a surface 26 of the pin head 20 and is formed of metal in one embodiment, but may be formed of other hard materials such as plastic, ceramic, or other suitably hard, sturdy material. The pin may be formed of a magnetically susceptible material. As used herein, "magnetically susceptible material" includes materials which may be attracted to a magnet, for example a paramagnetic material or a ferromagnetic material. As used herein "magnetic material" includes materials capable of attracting a magnetically susceptible material, for example a magnetized ferromagnetic or ferrimagnetic material. The pin 24 includes a tip 25 that is capable of piercing a number of surfaces, including but not limited to foamcore, sheetrock, cork, homosote, and the like, for example.

In the illustrated embodiment, the pin head 20 is formed of a ferrous metal and is cylindrical with a reverse conical protrusion 27 from its bottom. The surface 26 of this protrusion 27 has a cylindrical cavity to house and secure the pin 24. In order to complete all of its intended functions, the pin head 20 may be formed of a ferrous metal. However it may be formed of any number of materials, including but not limited to plastics, glass, ceramics, non-ferrous metals, and the like, possibly at the expense of losing some of its functions. Furthermore, the pin head 20 may take many forms, for example a cuboid, a sphere, or any other shape. In other embodiments the pin head 20 may be more fully exposed from the outer member 30, lending itself to better grasp and removal of the pin when the outer member 30 is collapsed. The outer exposed surface 22 of the pin head 20 may have a number of textures applied to facilitate gripping such as protrusions, indentations, ribs, knurling, and the like, for example. In other embodiments, the pin head 20 may be fully enveloped inside the outer member 30. If contained fully within the outer member 30, the outer member 30 may have a number of textures applied to make the pin head 20 more easy to grasp.

Figure 4C:
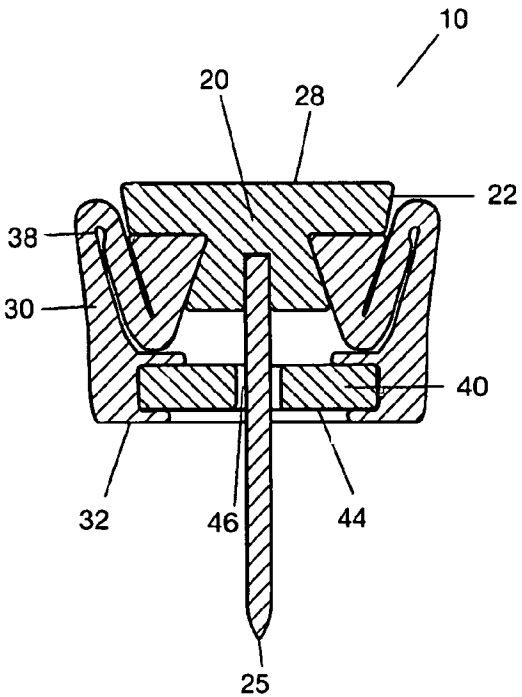
FIG. 4A-4C are side views of one embodiment of the magnetic safety push pin device as it is compressed and the pin is inserted into an acceptable surface.
Figure 5A:
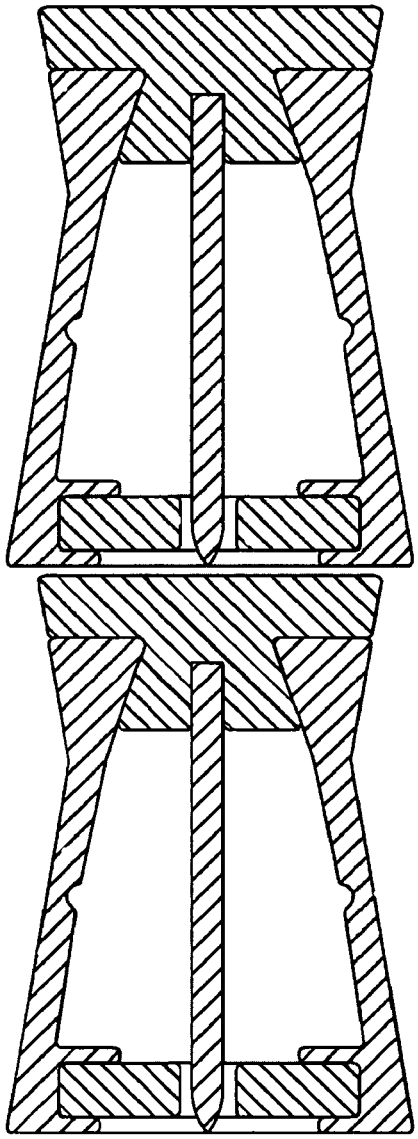
FIG. 5A-5B are side views of one embodiment of the magnetic safety push pin device in other useful configurations.
Figure 5B:
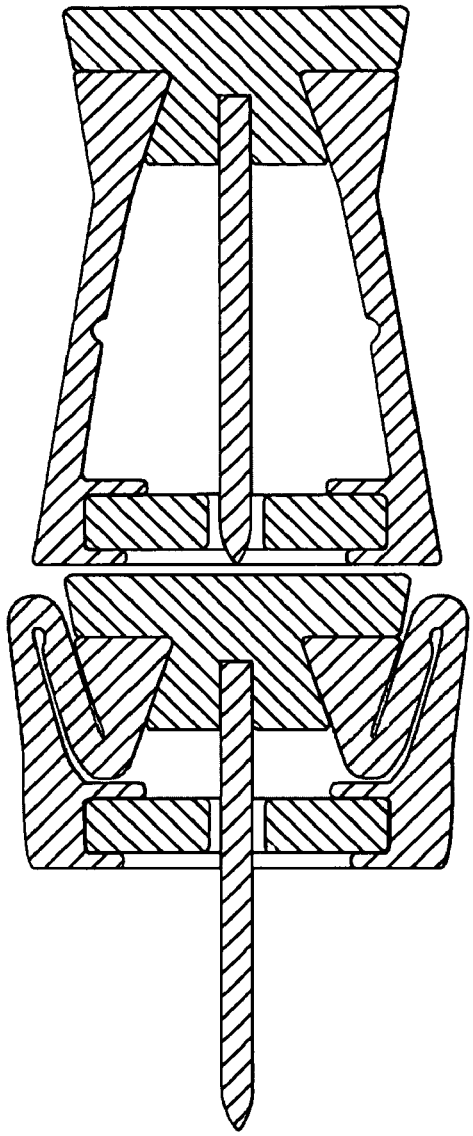

Referring to FIGS. 4C and 5A-B, the pin head 20 may be formed of ferrous metal so as to interact with the magnet 40 to perform at least two functions. First, the magnetic force between surface 26 and surface 42 enables the pin 24 to stay extended and secure articles to even soft and low friction pinnable materials. Second, the pin head 20 and the magnetic ring 40 may interact on surface 28 and surface 44 to be used as a stackable toy, for example (see FIG. 5A), or to magnetically fasten pages to a non-ferrous surface (see FIG. 5B), such as cork, homosote, or foamcore, for example.

The device 10 may comprise a natural state in which the pin 24 is sheathed inside. The pin 24 generally extends from the surface 26 of the pin head 20 down toward the center opening of the magnetic ring 46. Both the pin 24 and the magnetic ring 40 may be mostly enveloped by the outer member 30.

When the outer member 30 is compressed, it may deform, bend, and/or fold, for example at breakpoints 38, allowing it to collapse on itself. During this process the pin 24 is ejected through the hole of the magnetic ring 46. As the pin 24 moves beyond the magnetic ring, the tip of the pin 25 may contact and engage a pinnable surface. When the outer member 30 is fully compressed or nearly fully compressed, the pin 24 may be extended substantially to hold fast with friction to the pinnable surface, and the pin head 20 may be in close proximity to the magnet 40 increasing a magnetic attraction between the pin head 20 and the magnet 40 to hold the pin head 20 in close proximity to the magnet 40, thereby keeping the pin 24 extended and the outer member 30 collapsed with little opposing force to return to its natural state. In other embodiments, the pin head 20 may be magnetic and/or the magnet 40 may be magnetic.

In one embodiment, the outer member 30 is in the form of two hollow cones whose tips are intersecting, the abscess of which partially or fully houses the pin head 20, pin 24 and magnetic ring 40. This form lends itself well to the mechanics of the device 10 being able to collapse and subsequently return to its natural state. However the outer member 30 may take a wide variety of shapes and/or sizes.

The elastomeric outer member 30 may be formed from any deformable material(s), for example elastic, rubber, and/or foam material. In some embodiments the outer member may not have a hollow core. In other embodiments, the outer member preferably comprises a hollow core. The outer member 30 may also include protrusions from surface 32 to hold articles fast to surfaces without causing damage to said articles.

In the illustrated embodiment, the surface 32 along with the surface 34 are inward protrusions from the wall of the outer member 30. These protrusions create a cavity that houses and secures the magnetic ring 40 in its desired position. The magnetic ring 40 may be dually secured with a number of adhesives. Similarly, the pin head 20 is seated in the top opening 36 of the outer member 30. This top opening 36 is a conical void, though it may be different shapes in other embodiments. The pin head 20 may have a reverse conical member 27 protruding from its bottom which is housed and secured within the top opening 36 of the outer member 30. The pin head 20 can be dually secured with any number of adhesives or co-molded with the outer member 30. Any other suitable manufacturing processes may also be used.

Figure 4B:
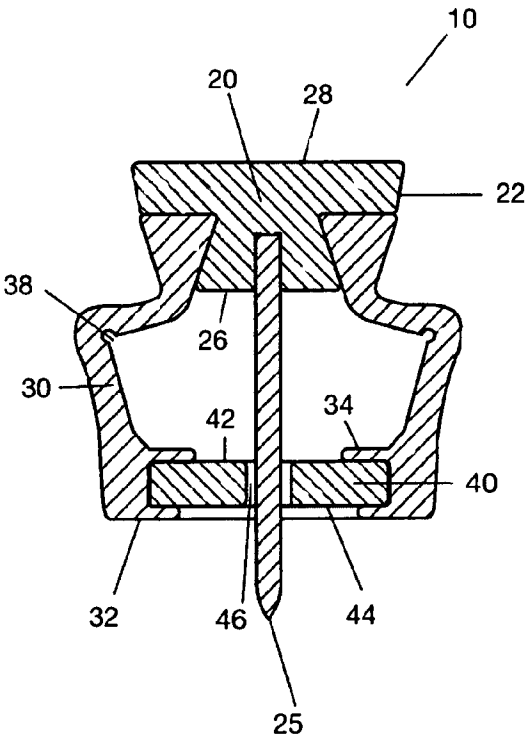
Figure 4A:
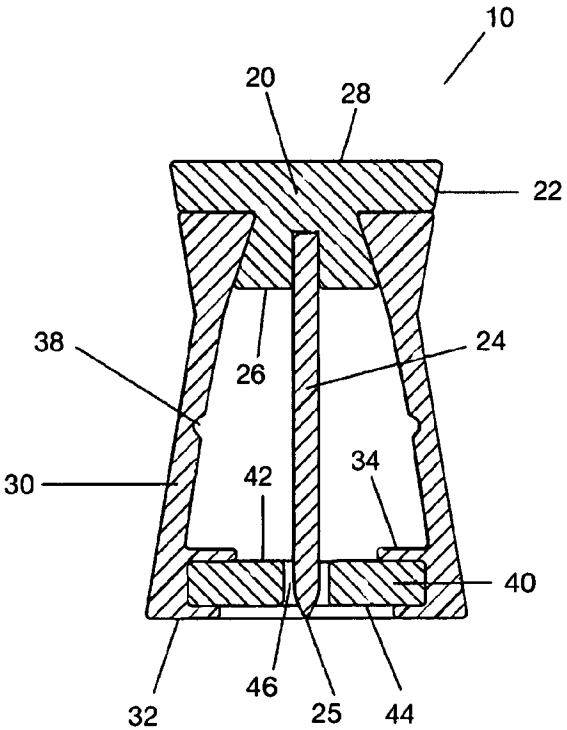

In the embodiment illustrated in FIGS. 4A-4C, there is a breakpoint 38 molded into the inner wall of the outer member 30 near the middle of wall. This breakpoint 38 facilitates a fluid folding motion when the outer member 30 is compressed, allowing the outer member 30 to fold in on itself cleanly and not crumple. In other embodiments, various other breakpoints or inflection points may be used to facilitate folding of the outer member. Other embodiments can allow the outer member 30 to crumple. While in this embodiment the breakpoint 38 is illustrated approximately mid-way, it may be located in any number of positions on the outer member 30. Furthermore, there may be multiple breakpoints molded into the device 10 to facilitate fluid collapsing mechanics. These mechanics may be used in a number of forms and sizes to produce desired results.

The magnetic ring 40 may be a permanent magnetic disk through the middle of which is an aperture or hole 46 configured to allow the pin 24 to be ejected or extended when intended to secure articles to a surface. The magnetic ring 40 may serve many functions usable in the mechanics of this device. One function may be simply to hold articles fast to a magnetic surface. Another may be to apply opposing force to the outer body 30 when the outer body 30 is in its compressed state. Still further the magnetic ring 40 may be used to magnetically hold articles between it and the top surface 28 of a second device that is compressed and pinned into a pinnable surface (see FIG. 5B), effectively making magnetic use of a pinnable surface. Finally, the magnetic ring 40 may be used to attract more like devices to stack and build structures similar to magnetic toys (see FIG. 5A).

Figure 6:
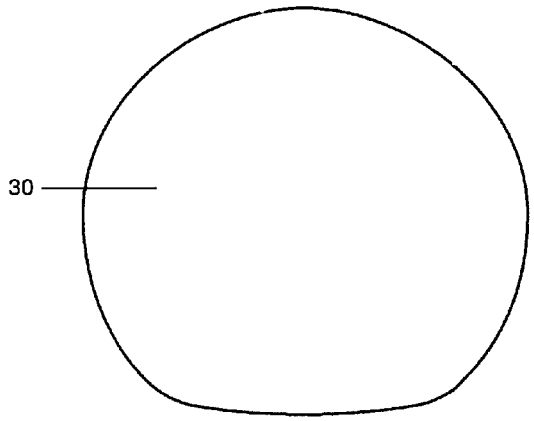
FIG. 6 is a side view of one embodiment of the magnetic push pin device.
Figure 7:
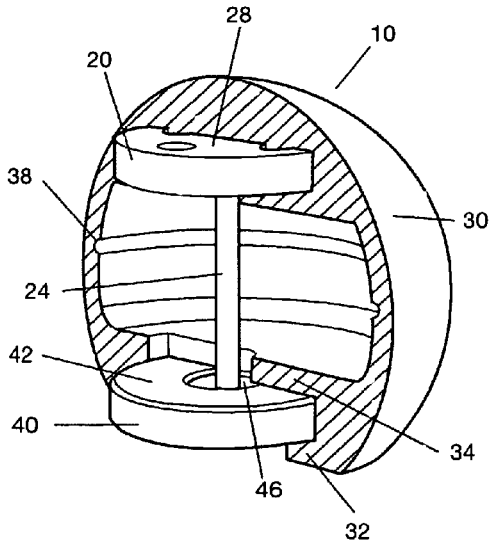
FIG. 7 is a cut-away perspective view of one embodiment of the magnetic safety push pin device shown in FIG. 6.

FIG. 6 is a side view of one embodiment of the magnetic push pin device 10. In the embodiment shown in FIG. 6 the outer body 30 is in the form of a partial sphere while substantially uncompressed. Also, the outer body 30 encloses substantially all of the pin head 20, the pin 24, and the magnetic ring 40, such that almost no part of the pin head 20 and the pin 24 are visible outside of the outer body 30 when the outer body 30 is uncompressed. FIG. 7 is a cut-away perspective view of one embodiment of the magnetic safety push pin device shown in FIG. 6. In the embodiment shown in FIG. 7, the device 10 includes a pin head 20 that has surface 28, and surface 28 is covered by the partially spherical outer body 30. The outer body 30 also defines a space that encloses at least part of the pin 24, and may enclose the entire pin 24. The outer body 30 also has a breakpoint 38 to facilitate the collapse of the outer body 30 and to decrease the resistance the outer body 30 exerts against the magnetic attraction between the magnetic ring 40 and the pin head 20. In some embodiments, multiple breakpoints can be used. In other embodiments, no breakpoint is provided. The outer body 30 may be textured to facilitate gripping. In other embodiments, the outer body 30 may be in the form of a cuboid, a parallelepiped, a spheroid, or any other three dimensional shape.

The descriptions set forth previously along with their accompanying illustrations are offered in the way of description and illustration of certain embodiments of the invention. It will be appreciated, however, that no matter how detailed the foregoing appears in text, the invention can be practiced in many ways. As certain embodiments have been described and shown, one should assume that modifications may be made to any and all parts without departing from the novel mechanics set forth. As is also stated above, it should be noted that the use of particular terminology when describing certain features or aspects of the invention should not be taken to imply that the terminology is being re-defined herein to be restricted to including any specific characteristics of the features or aspects of the invention with which that terminology is associated. The scope of the invention should therefore be construed in accordance with the appended claims and any equivalents thereof.

What is claimed is:

1. A pushpin device adapted to affix articles to different surfaces by piercing, by magnetic attraction, or by clamping and to enclose a pin to allow safer handling of the device by reducing the danger of injury being inflicted by an exposed point of the pin, the device comprising:

a pin head comprising magnetically susceptible material, wherein the pin head is adapted to allow a user to apply pressure to the pin head without discomfort;

a longitudinally extending pin having a proximal portion and a distal portion, the proximal portion of the longitudinally extending pin being coupled to the pin head and the distal portion of the longitudinally extending pin comprising a point at a distal end, wherein the point is adapted to allow the pin to penetrate user selected articles that are to be affixed to a surface;

a base comprising a magnetic material and having an aperture, wherein the base is magnetically attracted to the pin head by a magnetic force such that when the pin head is positioned proximate to the base the magnetic force maintains the pin head in a position proximate to the base in opposition to a countering force, and the aperture is aligned with the pin and is configured to allow the pin to pass through the base as the pin head moves proximate to the base; and a deformable outer member coupled to the pin head at a first end and coupled to the base at a second end that is distal to the first end, wherein the deformable outer member further comprises a first position wherein the pin head is spaced from the base and the deformable outer member is substantially undeformed and surrounds the entire pin along the longitudinal axis of the pin; and a second position wherein the deformable outer member is deformed and wherein the pin head is proximate to the base, thereby allowing the pin to extend through the aperture in the base to penetrate an article, and wherein the deformable outer member exerts the countering force on the base and the pin head.

2. The device of claim 1, wherein the deformable outer member defines a hollow space, and wherein the entire pin is positioned within the hollow space when the deformable outer member is in the first position.

3. The device of claim 1, wherein the deformable outer member further comprises one or more breakpoints adapted to facilitate the transition of the deformable outer member from the first position to the second position.

4. A pushpin device adaptable to affix articles to different surfaces and to improve user safety by reducing the danger of injury being inflicted by an exposed point, the device comprising:

a head adapted to allow a user to apply pressure to the head without discomfort;

a longitudinally extending fastening member comprising a point at a distal end and coupled to the head at a proximal end;

a base comprising an aperture, wherein the aperture is configured to allow the fastening member to pass through the base as the head moves proximate to the base; and an outer member coupled to the head and the base, wherein the outer member comprises a first position in which the head is spaced from the base and the outer member encloses a longitudinal segment of the fastening member; and a second position wherein the head is proximate to the base and the outer member is deformed, thereby allowing the fastening member to extend through the aperture, and wherein the outer member exerts a countering force on the base and the head;

wherein one of the head and the base comprises magnetically susceptible material and the other comprises magnetic material, and wherein a magnetic force between the head and the base maintains the outer member in the second position in opposition to the countering force.

5. The pushpin of claim 4, wherein the base is configured in a disk shape, and wherein the aperture is located substantially in the center of the disk.

6. The pushpin of claim 4, wherein the outer member defines a space and substantially the entire fastening member is positioned within the space when the outer member is in the first position.

7. The pushpin of claim 4, wherein the head further comprises a reverse conical member adapted to couple the head to the outer member.

8. The pushpin of claim 4, wherein a side of the head opposite the base comprises a substantially planar surface.

9. A fastening device adapted to increase user safety and to allow articles to be affixed to various types of surfaces by piercing the article or by clamping the article, the device comprising:

a head comprising a first surface adapted to be safely handled by a user;

a pin having a proximal portion and a distal portion, the proximal portion of the pin coupled to the head and the distal portion of the pin comprising a tip;

a base configured to allow at least part of the pin to extend therethrough; and a flexible member having a proximal portion and a distal portion, the distal portion coupled to the base and the proximal portion coupled to the head, wherein the flexible member is adapted to allow the head to be positioned proximate to the base;

wherein one of the head and the base comprises magnetic material and the other comprises magnetic material or magnetically susceptible material, and wherein the pin extends through the base when the pin head is positioned proximate to the base.

10. The fastening device of claim 9, wherein a magnetic attraction between the head and the base resists an opposing force exerted by the flexible member when the head is positioned proximate to the base, thereby maintaining the head proximate to the base.

11. The fastening device of claim 9, wherein the flexible member encloses a cavity, and wherein at least part of the pin is positioned within the cavity when the head is spaced from the base.

12. The fastening device of claim 11, wherein the flexible member comprises one or more breakpoints.

13. The fastening device of claim 9, wherein the first surface of the head includes a texture from the group consisting of: protrusions, indentations, ribs, and knurling.

14. A fastening device configured to reduce the risk of injury to a user and allow a user to affix articles to various surfaces by piercing or by friction, the fastening device comprising:

a head configured to allow a user to manually exert pressure on the head without discomfort;

a fastening member comprising a substantially sharp point adapted to penetrate an article:

a base comprising an aperture adapted to permit the fastening member to extend therethrough;

means for enclosing the fastening member in a first configuration when the fastening member is not in use to reduce the risk of user injury caused by the substantially sharp point;

means for coupling the fastening device to a first user selected surface in the first configuration, thereby allowing the fastening device to clamp an article to be affixed to the first user selected surface;

means for coupling the fastening device to a second user selected surface in a second configuration, thereby allowing the fastening device to pierce an article to be affixed to a second user selected surface; and means for holding the head proximate to the base in opposition to a resistive force that urges the base and the head apart, thereby allowing the fastening member to remain extended through the base to pierce an article to be affixed to a second user selected surface in the second configuration.

* * * * *